United States Patent [19]

Limburg et al.

[11] 4,330,608

[45] * May 18, 1982

[54] BENZOTRIAZOLE STABILIZED PHOTOSENSITIVE DEVICE

[75] Inventors: William W. Limburg, Penfield; Damodar M. Pai, Fairport, both of N.Y.

[73] Assignee: Xerox Corporation, Stamford, Conn.

[ * ] Notice: The portion of the term of this patent subsequent to Nov. 4, 1997, has been disclaimed.

[21] Appl. No.: 215,476

[22] Filed: Dec. 11, 1980

Related U.S. Application Data

[63] Continuation of Ser. No. 69,472, Aug. 24, 1979, abandoned.

[51] Int. Cl.[3] ..... G03G 5/14

[52] U.S. Cl. ..... 430/59; 430/512

[58] Field of Search ..... 430/58, 59, 73, 74, 430/78, 337, 338, 512

[56] References Cited

U.S. PATENT DOCUMENTS

| | | | |
|---|---|---|---|
| 3,004,896 | 10/1961 | Heller et al. | 430/512 |
| 3,253,921 | 5/1966 | Sawsey | 430/512 |
| 3,533,794 | 10/1970 | Ohi et al. | 430/512 |
| 3,542,547 | 11/1970 | Wilson | 430/72 |
| 4,050,935 | 9/1977 | Limburg et al. | 430/59 |
| 4,081,274 | 3/1978 | Horgan | 430/59 |
| 4,115,116 | 9/1978 | Stolka et al. | 430/59 |
| 4,140,529 | 2/1979 | Pai et al. | 430/59 |
| 4,232,103 | 11/1980 | Limburg et al. | 430/59 |

*Primary Examiner*—Roland E. Martin, Jr.
*Attorney, Agent, or Firm*—Peter H. Kondo; James P. O'Sullivan; John E. Beck

[57] ABSTRACT

An imaging member comprising a hole generation layer and a contiguous hole transport layer, said generation layer comprising a photoconductive material exhibiting the capability of photogeneration of holes and injection of said holes, said hole transport layer comprising a di or triarylmethane compound of the general formula:

wherein $R_1$ and $R_2$ are independently selected from the group consisting of a $C_1$–$C_8$ alkyl, aryl, alkaryl and aralkyl, where said aryl is a phenyl group or a condensed ring group, where the alkyl group of said alkaryl and aralkyl is a $C_1$–$C_4$ group; $R_3$ is independently selected from the group consisting of hydrogen and $CH_3$; and $R_4$ is the same as $R_1$ and $R_2$ or a disubstituted aminophenyl group wherein the substituents are independently selected from the group consisting of a $C_1$–$C_8$ alkyl, aryl, alkaryl and aralkyl as defined supra, said di or triarylmethane is dissolved in a polycarbonate resinous material, said charge transport layer being substantially nonabsorbing in the spectral region at which the photoconductive material generates and injects said holes, but being capable of supporting the injection of said holes and transporting said holes through said transport layer and dissolved in said transport layer a stabilizing proportion of a substituted or unsubstituted 2-(2'-hydroxyphenyl)-benzotriazole.

5 Claims, 1 Drawing Figure

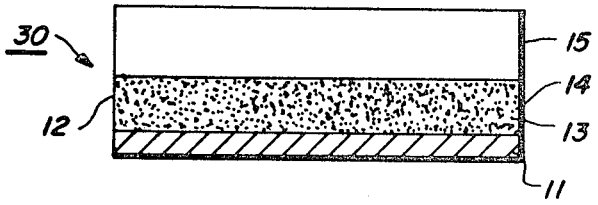
30
15
14
12
13
11

BENZOTRIAZOLE STABILIZED PHOTOSENSITIVE DEVICE

This is a continuation of application Ser. No. 069,472, filed Aug. 24, 1979, now abandoned.

BACKGROUND OF THE INVENTION

This invention relates in general to xerography and more specifically to a novel photosensitive device.

In recent years, interest has been shown in flexible electrophotographic plates for use in high speed office copying machines. Some of these plates are multilayered devices comprising, a conductive substrate layer, an adhesive-blocking interface layer, a charge generation layer and a charge transport layer. The charge transport layer comprises an organic charge transport molecule dissolved in a polymeric matrix material. This layer is substantially nonabsorbing in the spectral region of intended use, i.e. visible light, but is "active" in that it allows (1) injection of photogenerated holes from the charge generation layer and (2) efficient transport of these charges to the surface of the transport layer to discharge a surface charge thereon.

Certain classes of hole transport molecules, such as the diaryl and triarylmethanes, have been extensively studied as solutions or dispersions in polycarbonate polymers. The photooxidative stability of these classes of compounds has been found to be poor. As photoreceptor devices employing these classes of compounds are subjected to ultraviolet radiation, a condition known as "cycle up" progressively develops as the device is cycled in the xerographic machines. "Cycle up" refers to the bulk trapping of holes in the transport layer and in a relatively short period of time efficient discharge of the charged surface of the photoreceptor is lost.

OBJECTS OF THE INVENTION

It is therefore an object of this invention to provide a novel photosensitive device less susceptible to the deleterious effects of ultraviolet radiation degradation in the transport layer thereof.

It is a further object of this invention to provide an electrophotographic device free of "cycle up" problems caused by ultraviolet light induced degradation.

PRIOR ART STATEMENT

Chemical stabilization of the physical properties of polymers has been well pursued and a host of additives are available which stabilize various polymers against ultraviolet induced discoloration or ultraviolet induced mechanical failures. As far as is known, however, no study has been done to date on the chemical stabilization of electronic properties. By electronic stabilization is meant the elimination or minimizing of ultraviolet induced traps or ultraviolet induced dark decay and the like. To be useful as an electronic stabilizer in a cyclic duplicating machine, the additive, in addition to preventing ultraviolet degradation, has to meet another stringent requirement. The additive should not introduce traps of its own under cyclic conditions, since even a small number of traps result in the cumulative trapping phenomenon generally referred to as "cycle up". The trap could be an isolated electronic state of the additive or it could result from the additive changing the character of the dispersion of the host molecule in the binder matrix. As indicated, no prior art appears to have dealt precisely with the problem outlined above.

SUMMARY OF THE INVENTION

The foregoing objects and others are accomplished in accordance with this invention by providing a photosensitive member comprising a generator layer and a transport layer wherein said transport layer comprises a solution or dispersion of a diaryl or triarylmethane compound in a polycarbonate resin and a stabilizing proportion of a substituted or unsubstituted 2-(2'-hydroxyphenyl)-benzotriazole also present therein.

It has been found that the addition to the transport layer of a substituted or unsubstituted 2-(2'-hydroxyphenyl)-benzotriazole significantly reduces or eliminates photoreactions leading to the deleterious effects of ultraviolet radiation which result in early "cycle up". The use of this class of additives has no apparent deleterious effects of its own on the chemical or electrical properties of the hole transport layer.

In general, the advantages of the invention will become apparent upon consideration of the following disclosure of the invention, especially when taken in conjunction with the accompanying drawing wherein:

BRIEF DESCRIPTION OF THE DRAWING

The FIGURE is a schematic illustration of one of the members of the instant invention which comprise a photoreceptor having a charge generation layer overcoated with a charge transport layer.

DETAILED DESCRIPTION OF THE DRAWING AND INVENTION

Referring to the Figure, reference character 30 designates an imaging member which comprises a supporting substrate 11 having a charge generator layer 12 thereon. Substrate 11 is preferably comprised of any suitable conductive material. Typical conductors comprise aluminum, steel, nickel, brass or the like. The substrate may be rigid or flexible and of any convenient thickness. Typical substrates include flexible belts of sleeves, sheets, webs, plates, cylinders and drums. The substrate or support may also comprise a composite structure such as a thin conductive coating contained on a paper base; a plastic coated with a thin conductive layer such as aluminum, nickel or copper iodine; or glass coated with a thin conductive coating of chromium or tin oxide.

In addition, if desired, an electrically insulating substrate may be used. In this case, an electric charge, equivalent to a conductive layer, may be placed upon the insulating member by double corona charging techniques well known or disclosed in the art. Other modifications using an insulating substrate or no substrate at all include placing the imaging member on a conductive backing member or plate in charging the surface while in contact with said backing member. Subsequent to imaging, the imaging member may then be stripped from the conductive backing.

Generator layer 12 contains photoconductive particles dispersed randomly without orientation in binder 14.

Binder material 14 may comprise any electrically insulating resin such as those disclosed in Middleton et al U.S. Pat. No. 3,121,006, the entire contents of which are hereby incorporated by reference. Specific examples are polystyrene, acrylic and methacrylic ester polymers, polyvinylchlorides, etc. When using an electrically inactive or insulating resin, it is essential that there be particle to particle contact between the photoconductive particles. This necessitates that the photoconductive material be present in an amount of at least about 10% by volume of the binder layer with no limit on the maximum amount of photoconductor in the binder layer. If the matrix or binder comprises an active material, e.g., polyvinyl carbazole, the photoconductive material need only comprise about 1% or less by volume of the binder layer with no limitation on the maximum amount of photoconductor in the binder layer. The thickness of binder layer 12 is not critical. Layer thicknesses from about 0.05 to 40.0 microns have been found to be satisfactory.

The photoconductive particles 13 may be any material capable of photogenerating holes and injecting photogenerated holes into the contiguous charge transport layer 15. Any suitable inorganic or organic photoconductor and mixtures thereof my be employed. Inorganic materials include inorganic crystalline photoconductive compounds and inorganic photoconductive glasses. Typical inorganic compounds include cadmium sulfoselenide, cadmium selenide, cadmium sulfide and mixtures thereof. Typical inorganic photoconductive glasses include amorphous selenium and selenium alloys such as selenium-tellurium, selenium-tellurium-arsenic and selenium-arsenic and mixtures thereof. Selenium may also be used in a crystalline form known as trigonal selenium.

Typical organic photoconductive materials which may be used as charge generators include phthalocyanine pigment such as the X-form of metal free phthalocyanine described in U.S. Pat. No. 3,357,989 to Byrne et al; metal phthalocyanines such as copper phthalocyanine; quinacridones available from duPont under the tradename Monastral Red, Monastral Violet and Monastral Red Y; substituted 2,4-diamino-triazines disclosed by Weinberger in U.S. Pat. No. 3,445,227; triphenodioxazines disclosed by Weinberger in U.S. Pat. No. 3,442,781; polynuclear aromatic quinones available from Allied Chemical Corporation under the tradename Indo Double Scarlet, Indofast Violet Lake B, Indofast Brilliant Scarlet and Indofast Orange. The photoconductive particles may be present in the generator layer in from 0.5% to about 95% by volume depending on the character of the binder material.

It is to be understood that the generator layer need not be dispersed photoconductive particles in a resin binder but can be a homogeneous layer, such as, amorphous selenium, selenium alloys e.g. selenium-tellurium-arsenic alloys and, in fast, any other charge generating photoconductive material which can withstand a minimum flexing stress required in a flexible photoreceptor.

Active layer 15 comprises a transparent electrically inactive polycarbonate resinous material having dispersed therein from about 25 to 75% by weight of one or more of the di or triphenylmethanes within the scope of the following structural formula:

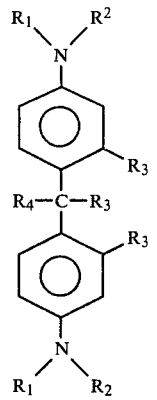

wherein $R_1$ and $R_2$ are independently selected from the group consisting of a $C_1$–$C_8$ alkyl, aryl, alkaryl and aralkyl, where said aryl is a phenyl group or a condensed ring group, where the alkyl group of said alkaryl and aralkyl is a $C_1$–$C_4$ group, $R_3$ is independently selected from the group consisting of hydrogen and $CH_3$; and $R_4$ is the same as $R_1$ and $R_2$ or a disubstituted aminophenyl group wherein the substituents are independently selected from the group consisting of a $C_1$–$C_8$ alkyl, aryl, alkaryl and aralkyl as defined supra.

In general, the thickness of active layer 15 would be from about 5 to 100 microns, but thicknesses outside this range can also be used.

The preferred polycarbonate resins for the transport layer have a molecular weight from about 20,000 to about 120,000, more preferably from about 50,000 to about 120,000.

Materials most preferred as the electrically inactive resinous material are poly(4,4'-isopropylidene-diphenylene carbonate) having molecular weights of from about 25,000 to about 40,000, available as Lexan® 145, from about 40,000 to about 45,000, available as Lexan® 141, both from the General Electric Company; and from about 50,000 to about 120,000 available as Makrolon®, from Farbenfabricken Bayer AG; and from about 20,000 to about 50,000 available as Merlon®, from Mobay Chemical Company.

Active layer 15, as described above, is substantially nonabsorbing to light in the wavelength region employed to generate holes in the photoconductive layer. This preferred range for xerographic utility is from about 4,000 to about 8,000 angstrom units. In addition, the photoconductor should be responsive to all wavelengths from 4,000 to 8,000 angstrom units if panchromatic responses are required. All photoconductor-active material combinations of the instant invention result in the injection and subsequent transport of holes across the physical interface between the photoconductor and the active material.

Dispersed or dissolved in the transport layer in order to greatly minimize or eliminate the deleterious effects of ultraviolet radiation is a stabilizing proportion of a substituted or unsubstituted 2-(2'-hydroxyphenyl)benzotriazole having the following structural formula:

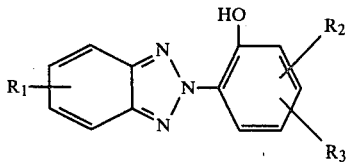

wherein $R_1$ is hydrogen or a $C_1$–$C_5$ alkyl, aryl, alkaryl, aralkyl, sulfhydryl, $NO_2$ or a halogen; and wherein $R_2$ and $R_3$ are independently selected from the group consisting of a $C_1$–$C_5$ alkyl, aryl alkaryl, or aralkyl group.

Preferred compounds within this generic description are 2-(2'-hydroxy-3'-tert-butyl-5'-methylphenyl)-5-chlorobenzotriazole, 2-(2'-hydroxy-5'-methylphenyl)-benzotriazole and 2-(2'-hydroxy-3',5'-di-t-butylphenyl)-benzotriazole.

Unexpectedly, when sufficient amounts of the preferred compound is used it completely prevents UV radiation from deleteriously altering the transport molecule, is not consumed during its act of stabilization, and does not introduce either shallow or deep traps which would result in charge residuals.

These stabilizers usually are effective when present in an amount equal to from 0.1–10 weight percent based on the weight of the transport compound. The following examples further specifically define the present invention with respect to the photosensitive member. The examples will show a comparison between charge transport layers not containing the stabilizing benzotriazole versus transport layers containing the stabilizing benzotriazole. The percentages are by weight unless otherwise indicated.

EXAMPLE I

A one micron layer of amorphous selenium is vacuum evaporated on a 3 mil aluminum substrate by a conventional vacuum deposition technique such as those disclosed by Bixby in U.S. Pat. Nos. 2,753,278 and 2,970,906. Prior to evaporating the amorphous selenium on the substrate, a 0.5 micron layer of an epoxy phenolic barrier layer is formed over the aluminum by dip coating. Vacuum deposition is carried out at a vacuum of $10^6$ Torr, while the substrate is maintained at a temperature of about 50° C. during the vacuum deposition. A 22 micron thick layer of charge transport material comprising 44.4% by weight of bis-(4-diethylamino-2-methyl phenyl)phenyl methane and 55.6% by weight of poly(4,4'-isopropylidene-diphenylene carbonate) available as Lexan ® 141 from General Electric Company is coated over the amorphous selenium layer.

The charge transport layer is prepared by dissolving in 135 grams of methylene chloride, 10.8 grams of bis-(4-diethylamino-2-methyl phenyl) phenyl methane and 13.5 grams of the Lexan ® 141. A layer of this solution is formed on the amorphous selenium layer by using a Bird Film Applicator. The coating is then dried at room temperature for between 24–48 hours to form a 22 micron thick dry layer of charge transport material.

EXAMPLE II

A photosensitive layer structure the same as that illustrated in Example I is prepared except the charge transport layer is prepared by dissolving in 13.5 grams of tetrahydrofuran, 10.8 grams of bis-(4-diethylamino-2-methyl phenyl) phenyl methane and 13.5 grams of the polycarbonate Merlon ® from Mobay Chemical Company.

EXAMPLE III

A photosensitive layer structure the same as that described in Example I was prepared except that 0.018 grams (i.e. one wt. percent based on the triphenyl methane) of 2-(2'-hydroxy-3'-tert-butyl-5'-methyl phenyl)-5-chlorobenzotriazole was dispersed in the charge transport layer along with the triphenyl methane compound. The chlorobenzotriazole is currently available from CIBA-Geigy Corporation.

EXAMPLE IV

The photosensitive layer structure of Example I is again prepared except that 0.81 grams (7.5 wt. percent based on the triphenyl methane compound) is included in the charge transport layer.

The device of Example I is corona charged negatively to 1500 volts and subjected to a light flash of 4330 Angstrom wavelength and approximately 15 ergs/cm$^2$ intensity. The device discharges from its initial potential to approximately 150 volts. This residual potential results from trapping at the interface between the selenium and the transport layer. The device of Example II similarly charged and discharged likewise showed a residual of approximately 150 volts. The devices of Examples I and II were subjected to irradiation from a long wavelength ultraviolet source for a period of about 2 minutes. The total light flux is approximately $6\times10^{16}$ photons/cm$^2$. When corona charged and again subjected to the 4330 Angstrom light source, the residual potential is increased by approximately 400 volts in both cases. This is caused by bulk hole traps generated by the ultraviolet source.

Devices so easily degradable are not useful in a xerographic machine when the photoreceptor can be subjected to ultraviolet radiation anytime during operation of the machine.

The devices of Examples III and IV when charged negatively to 1500 volts and then subjected to a light flash of 4330 Angstrom units wavelength and approximately 15 ergs/cm$^2$ intensity showed identical behavior to the devices of Examples I and II before they were subjected to ultraviolet energy. This shows that the additive does not alter the electrical behavior by its presence.

The device of Example III was then subjected to irradiation from a long wavelength ultraviolet source for a period of approximately 2 minutes. The total light flux was the same as above. When xerographically tested as above, the residual potential was approximately 250 volts instead of the 400 volts obtained in the devices not containing the chlorobenzotriazole compound. The reduction in residual as a result of the addition of the benzotriazole shows a considerable stabilization effect.

The device of Example IV was subjected to the same long wavelength ultraviolet source for a period of approximately 2 minutes. The total light flux was the same as above. When tested xerographically, there was no increase in residuals from those observed with a nonexposed film. In other words, the presence of 7.5 wt. percent of the 2-(2'-hydroxy-3'-tertbutyl-5'-methyl phenyl)-5-chlorobenzotriazole fully stabilized the transport molecule in the polycarbonate resin against any deterioration due to ultraviolet radiation.

EXAMPLE V

The photoconductive device of Examples I and IV were prepared except that trigonal selenium was employed in place of amorphous selenium. When tested xerographically before being subjected to ultraviolet energy, similar behavior was noted, i.e. the devices discharge from about 1500 volts to about 150 volts. This indicated that the chlorobenzotriazole does not introduce charge traps of its own. After subjecting the devices to the same ultraviolet source and intensity as in Example IV, and testing it xerographically, the device without the additive showed a residual of 400 volts but the device with the additive was unchanged from the discharge point of 150 volts.

Devices, as in Example IV, were fabricated using 7.5 wt. percent of 2-(2'-hydroxy-5'-methylphenyl)-benzotriazole and 2-(2'-hydroxy-3',5'-di-t-butylphenyl)-benzotriazole respectively. These additives did not introduce traps of their own and the devices were effectively stabilized against ultraviolet degradation.

Other specific transport molecules effective in the devices of the present invention are bis-(4-diethylaminophenyl) methane, bis-(4-diethylamino-2-methylphenyl)-4-diethylaminophenyl methane and bis-(4-dibenzylamino-2-methylphenyl) phenyl methane. Devices containing these transport molecules are also effectively stabilized by use of a chlorobenzotriazole as defined herein.

What is claimed is:

1. In an imaging member comprising a hole generation layer and a contiguous hole transport layer, said generation layer comprising a photoconductive material exhibiting the capability of photogeneration of holes and injection of said holes, said hole transport layer comprising a di or triarylmethane compound of the general formula:

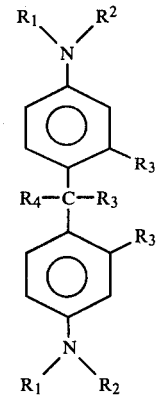

wherein $R_1$ and $R_2$ are independently selected from the group consisting of a $C_1$–$C_8$ alkyl, aryl, alkaryl and aralkyl, where said aryl is a phenyl group or a condensed ring group, the alkyl group of said alkaryl and aralkyl is a $C_1$–$C_4$ group; $R_3$ is independently selected from the group consisting of hydrogen and $CH_3$; and $R_4$ is the same as $R_1$ and $R_2$ or a disubstituted aminophenyl group wherein the substituents are independently selected from the group consisting of a $C_1$–$C_8$ alkyl, aryl, alkaryl and aralkyl, said di or triarylmethane is dissolved in a polycarbonate resinous material in a proportion of about 25–75% by weight, said charge transport layer being substantially nonabsorbing in the spectral region at which the photoconductive material generates and injects said holes, but being capable of supporting the injection of said holes and transporting said holes through said transport layer, the improvement consisting of stabilizing said triarylmethane compound against the deleterious effects of ultraviolet light by the presence in said transport layer of a stabilizing proportion of a substituted or unsubstituted 2-(2'-hydroxyphenyl)-benzotriazole.

2. The member of claim 1 wherein the benzotriazole has the following general formula:

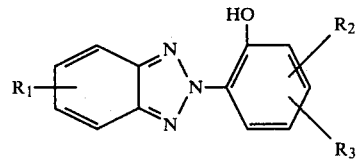

wherein $R_1$ is hydrogen or a $C_1$–$C_5$ alkyl, an aryl, alkaryl, aralkyl, sulfhydryl, $NO_2$ or a halogen; and $R_2$ and $R_3$ are independently selected from the group consisting of hydrogen, a $C_1$–$C_5$ alkyl, aryl, alkaryl or aralkyl group.

3. The member of claim 2 wherein said transport layer is stabilized by a member selected from the group consisting of 2-(2'-hydroxy-3'-t-butyl-5'-methylphenyl)-5-chlorobenzotriazole; 2-(2'-hydroxy-5'-methylphenyl)-benzotriazole; and 2-(2'-hydroxy-3',5'-di-t-butylphenyl)-benzotriazole.

4. The member of claim 3 wherein said photoconductive material is trigonal selenium and said triaryl methane compound is bis(4-diethylamino-2-methylphenyl)-phenylmethane.

5. The member of claim 3 wherein the benzotriazole compound is present in from about 0.1–10 percent by weight based on the weight of the transport molecule.

* * * * *